US010583542B2

(12) United States Patent
Su

(10) Patent No.: US 10,583,542 B2
(45) Date of Patent: Mar. 10, 2020

(54) PIPE WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 278 days.

(21) Appl. No.: 15/684,988

(22) Filed: Aug. 24, 2017

(65) Prior Publication Data

US 2018/0161964 A1 Jun. 14, 2018

(30) Foreign Application Priority Data

Dec. 9, 2016 (TW) ..... 105140943 A

(51) Int. Cl.

| | |
|---|---|
| ***B25B 13/50*** | (2006.01) |
| ***B25B 7/10*** | (2006.01) |
| ***B25B 13/14*** | (2006.01) |
| *B25B 13/10* | (2006.01) |

(52) U.S. Cl.

CPC ..... *B25B 13/5025* (2013.01); *B25B 7/10* (2013.01); *B25B 13/14* (2013.01); *B25B 13/10* (2013.01)

(58) Field of Classification Search

CPC ... B25B 7/10; B25B 13/5025; B25B 13/5041; B25B 13/5058; B25B 13/14; B25B 13/10

USPC ..... 81/179, 129, 139, 184

See application file for complete search history.

(56) References Cited

U.S. PATENT DOCUMENTS 481,506 A * 8/1892 McGilvray ..... B25B 23/0057 81/184
786,788 A * 4/1905 Hudson ..... B25B 13/22 81/139
791,117 A * 5/1905 Uren ..... B25B 23/0057 81/184
804,600 A * 11/1905 Harris ..... B25B 13/22 81/139
838,552 A * 12/1906 Landers ..... B25B 23/0057 81/184
1,182,763 A * 5/1916 Green ..... B25B 7/04 81/185.1
4,356,743 A * 11/1982 Muschalek, Jr. ... B25B 13/5058 81/180.1

(Continued)

FOREIGN PATENT DOCUMENTS

CN 2346543 Y 11/1999
CN 201300386 Y 9/2009

(Continued)

*Primary Examiner* — David B. Thomas

(74) *Attorney, Agent, or Firm* — Alan D. Kamrath; Karin L. Williams; Mayer & Williams PC

(57) ABSTRACT

A pipe wrench includes a first body and a second body. The first body includes a handle portion and a first clamping portion. The second body is movably coupled to the first body and has a body portion. The body portion defines a thorough hole with which the first body is insertably engaged. The body portion includes a second clamping portion. The first and second clamping portions face oppositely and cooperate with one another. The body portion is reinforced with at least one reinforcement ridge. The at least one reinforcement ridge extends from an outer periphery of the body portion. The second body is movable to various fixed positions on the first body.

15 Claims, 4 Drawing Sheets

(56) References Cited

U.S. PATENT DOCUMENTS

| | | | | |
|---|---|---|---|---|
| 5,095,783 | A * | 3/1992 | Majima | B25B 13/14 81/165 |
| 6,938,525 | B2 * | 9/2005 | Poole | B25B 5/068 81/151 |
| 7,966,913 | B2 * | 6/2011 | Vollenweider | B25B 13/14 81/120 |
| 10,189,149 | B2 * | 1/2019 | Watson | B25B 7/02 |
| 2009/0193940 | A1 * | 8/2009 | Kuo | B25B 13/5058 81/145 |
| 2015/0360351 | A1 * | 12/2015 | Harvey | B25B 13/5058 81/167 |

FOREIGN PATENT DOCUMENTS

| | | | |
|---|---|---|---|
| CN | 203765571 | U | 8/2014 |
| TW | 493505 | U | 7/2002 |
| TW | M524891 | U | 7/2016 |

* cited by examiner

PIPE WRENCH

BACKGROUND OF THE INVENTION

1. Field of the Invention

The present invention relates to a pipe wrench and, particularly, to a pipe wrench adapted to grip pipes and pipe fittings.

2. Description of the Related Art

TW Pat. No. 493505 shows a pipe wrench. The pipe wrench includes a fixed jaw and a movable jaw cooperating with the fixed jaw such that a pipe is gripped between the fixed and movable jaws. The first jaw is fixedly disposed on a front end of a shank body. The shank defines a through hole receiving another shank, and the movable jaw is located at an end of another shank. However, stress concentrations occur due to the presence of the through hole, and the shaft is damaged after undergoing high torque transmissions.

The present invention is, therefore, intended to obviate or at least alleviate the problems encountered in the prior art.

SUMMARY OF THE INVENTION

According to the present invention, a pipe wrench includes a first body and a second body. The first body includes a handle portion at a first end thereof and a first clamping portion at a second end thereof. The second body is movably coupled to the first body. The second body has a body portion. The body portion defines a through hole with which the first body is insertably engaged. The body portion includes a second clamping portion. The first and second clamping portions face oppositely and cooperate with one another. The body portion is reinforced with at least one reinforcement ridge. The at least one reinforcement ridge extends from an outer periphery of the body portion. The second body is movable to various fixed positions on the first body, thereby changing positions of the second clamping portion relative to the first clamping portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a pipe wrench with reinforcement ribs, so that it can transmit high torque without damaging components thereof.

Other objectives, advantages, and new features of the present invention will become apparent from the following detailed description of the invention when considered in conjunction with the accompanied drawings.

DETAILED DESCRIPTION OF THE INVENTION

Figure 1:
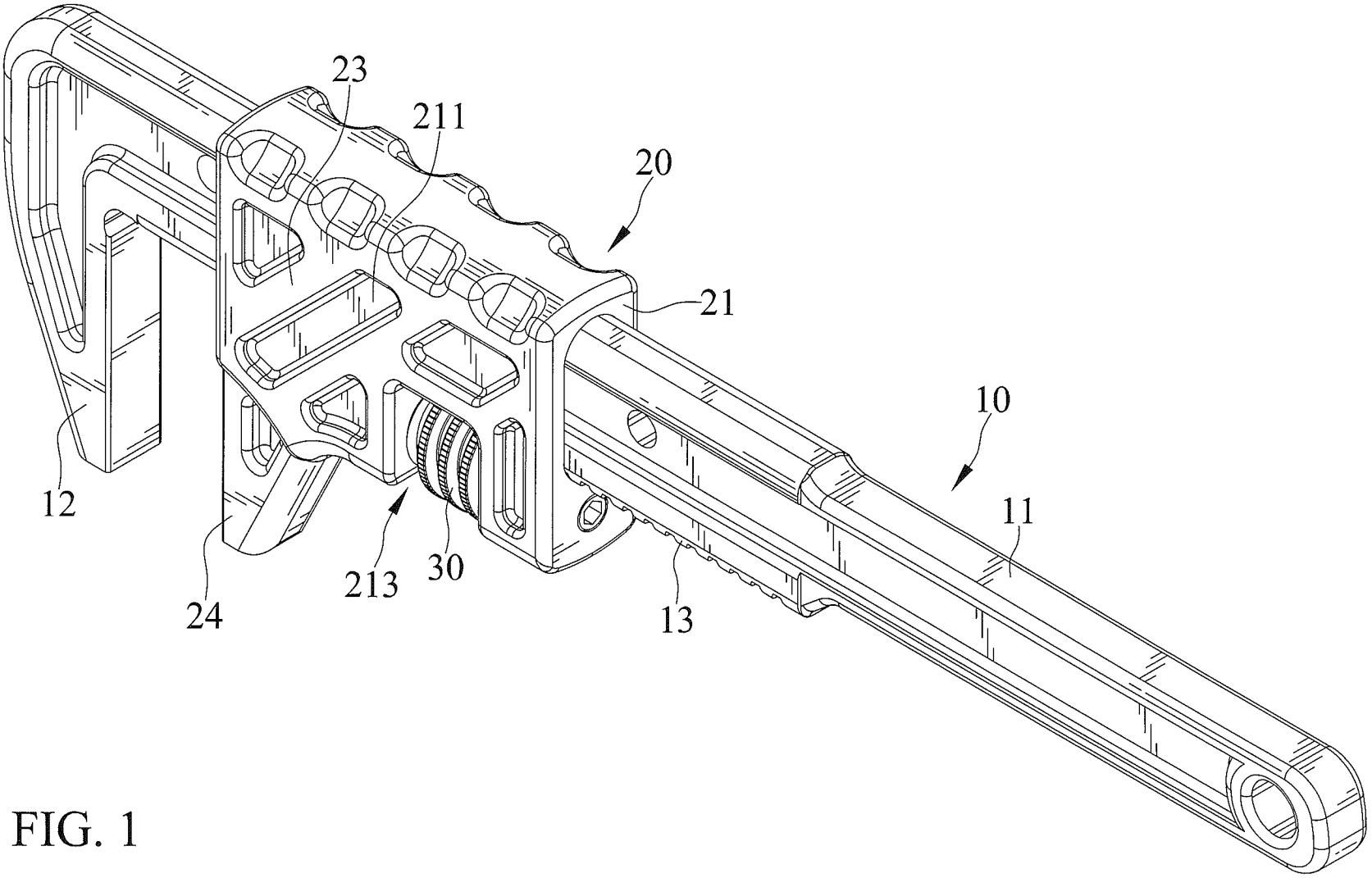
FIG. 1 is a perspective view of a pipe wrench in accordance with the present invention.
Figure 2:
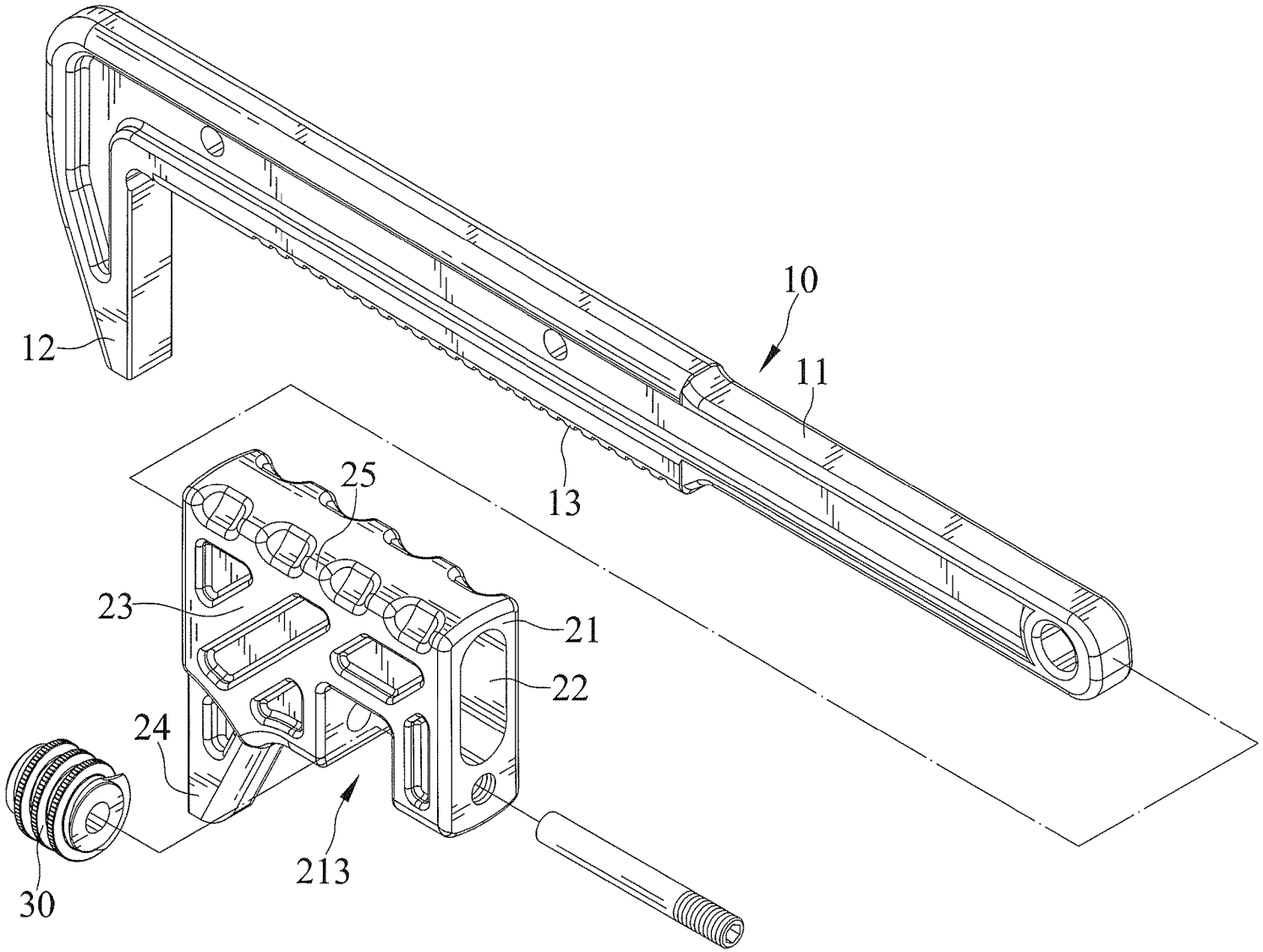
FIG. 2 is an exploded perspective view of the pipe wrench of the present invention.
Figure 3:
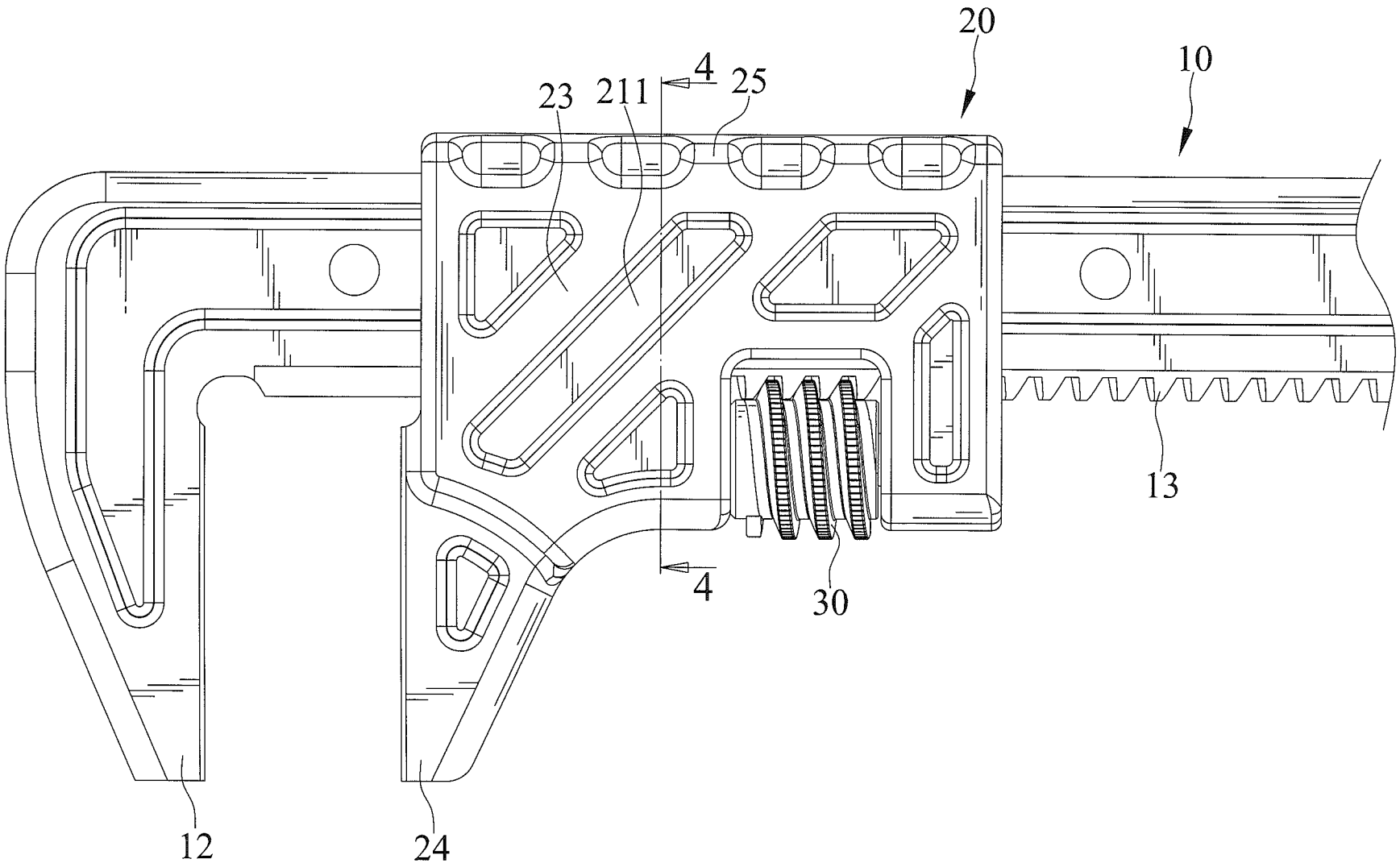
FIG. 3 is a partial, enlarged view of the pipe wrench of the present invention.
Figure 4:
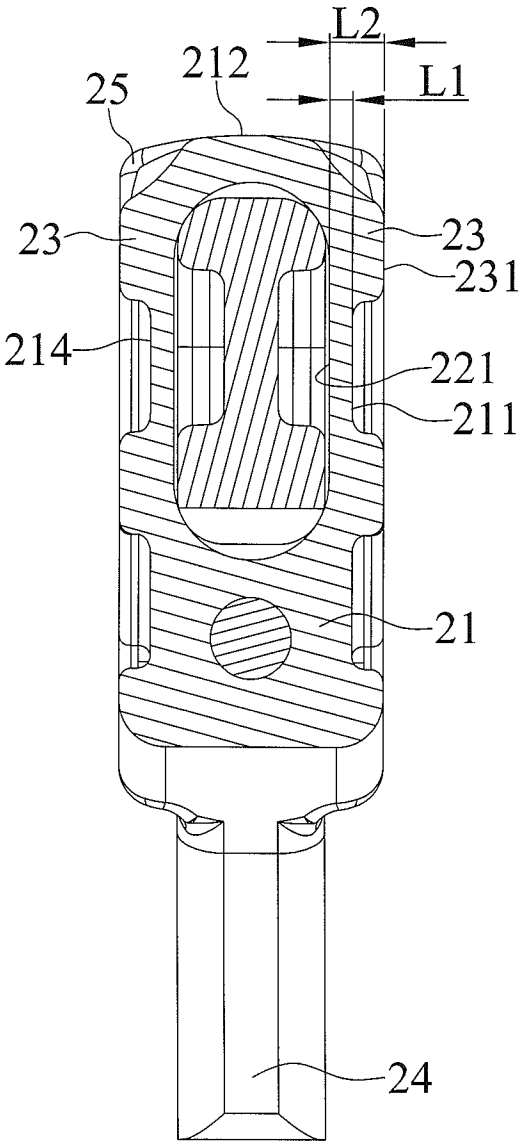
FIG. 4 is a cross-sectional view taken along 4-4 of FIG. 3.

FIGS. 1 through 4 show a pipe wrench in accordance with the present invention. The pipe wrench includes a first body 10 and a second body 20.

The first body 10 includes a handle portion 11 at a first end thereof and a first clamping portion 12 at a second end thereof.

The second body 20 is movably coupled to the first body 10. The second body 20 has a body portion 21. The body portion 21 defines a through hole 22 with which the first body 10 is insertably engaged. The through hole 22 has a first opening at a first end and a second opening at a second end. The body portion 21 includes a second clamping portion 24 cooperating with the first clamping portion 12. When the pipe wrench clamps an object, the object is gripped by and is disposed between the first and second clamping portions 12 and 24. The first and second clamping portions 12 and 24 face oppositely. The second body 20 can move axially on the first body 10. Thus, the second clamping portion 24 is axially displaced with respect to the first clamping portion 12 in response to the movement of the second body 20 with respect to the first body 10.

The second body 20 is movable to various fixed positions on the first body 10, thereby changing positions of the second clamping portion 24 relative to the first clamping portion 12. The first body 10 includes a row of a plurality of teeth 13 disposed between the handle portion 11 and the first clamping portion 12. The second body 20 defines a space 213 and includes a worm 30 restrained in the space 213 and engaging with the plurality of teeth 13. The worm 30 has a helical tooth in its peripheral surface, and the row of the plurality of teeth 13 can successively mate with the helical tooth. By rotating the worm 30, the second body 20 can move axially on the first body 10.

The body portion 21 is reinforced with at least one reinforcement ridge. The at least one reinforcement ridge extends from an outer periphery of the body portion 21. The outer periphery of the body portion 21 includes a first surface 211 extending laterally and the at least one reinforcement ridge includes at least one first reinforcement ridge 23 extending from the first surface 211. The through hole 22 includes a wall 221 extending laterally. The first surface 211 is spaced from the wall 221 at a first distance L1. The at least one first reinforcement ridge includes an outermost side 231 spaced from the wall 221 at a second distance L2. The second distance L2 is greater than the first distance L1.

Furthermore, the outer periphery of the body portion 21 includes a second surface 212 and a third surface 214. The second surface 212 extends transversely between the first and third surfaces 211 and 214. The first and third surfaces 211 and 214 extend laterally. The through hole 22 is disposed between the first and third surfaces 211 and 214. The outer periphery of the body portion 21 includes a fourth surface opposite the second surface 212, and the second clamping portion 24 extends from the fourth surface.

Furthermore, the at least one reinforcement ridge includes at least one second reinforcement ridge 23 extending from the third surface 214. The at least one first and second reinforcement ridges 23 are symmetrical. The at least one first and second reinforcement ridges 23 are mirror images of one another. The at least one reinforcement ridge includes at least one third reinforcement ridge 25 extending from a corner between the first and second surfaces 211 and 212. The at least one third reinforcement ridge 25 partially extends on the first surface 211 and integrates with the at least one first reinforcement ridge 23 and partially extends on the second surface 212. The at least one reinforcement ridge includes at least one fourth reinforcement ridge 25 extending from a corner between the second and third surfaces 212 and 214. The at least one fourth reinforcement ridge 25 partially extends on the third surface 214 and integrates with the at least second reinforcement ridge 23 and partially extends on the second surface 212.

In view of the forgoing, the body portion 21 is reinforced. The at least one reinforcement ridge includes the at least one first, second, third, and fourth reinforcement ridges reinforcing the outer periphery of the body portion 21. The reinforcement ridges can reduce stress concentrations, so that the pipe wrench can transmit high torque without damaging components thereof.

The foregoing is merely illustrative of the principles of this invention, and various modifications can be made by those skilled in the art without departing from the scope and spirit of the invention.

What is claimed is:

1. A pipe wrench comprising:

a first body including a handle portion at a first end thereof and a first clamping portion at a second end thereof; and a second body movably coupled to the first body and having a body portion, with the body portion defining a through hole with which the first body is insertably engaged, with the body portion including a second clamping portion, with the first and second clamping portions facing oppositely and cooperating with one another, wherein the body portion is reinforced with at least one reinforcement ridge, with the at least one reinforcement ridge extending from an outer periphery of the body portion, and wherein the second body is movable to various fixed positions on the first body, thereby changing positions of the second clamping portion relative to the first clamping portion, wherein the outer periphery of the body portion includes a first surface extending laterally and the at least one reinforcement ridge includes at least one first reinforcement ridge extending from the first surface, wherein the through hole includes a wall extending laterally, wherein the first surface is spaced from the wall at a first distance, wherein the at least one first reinforcement ridge includes an outermost side spaced from the wall at a second distance, and wherein the second distance is greater than the first distance.

2. The pipe wrench as claimed in claim 1, wherein the outer periphery of the body portion includes a second surface and a third surface, wherein the second surface extends transversely between the first and third surfaces, wherein the first and third surfaces extending laterally, and wherein the through hole is disposed between the first and third surfaces.

3. The pipe wrench as claimed in claim 2, wherein the outer periphery of the body portion includes a fourth surface opposite the second surface, and the second clamping portion extends from the fourth surface.

4. The pipe wrench as claimed in claim 3, wherein the at least one reinforcement ridge includes at least one second reinforcement ridge extending from the third surface.

5. The pipe wrench as claimed in claim 4, wherein the at least one first and second reinforcement ridges are symmetrical.

6. The pipe wrench as claimed in claim 5, wherein the at least one first and second reinforcement ridges are mirror images of one another.

7. The pipe wrench as claimed in claim 4, wherein the at least one reinforcement ridge includes at least one third reinforcement ridge extending from a corner between the first and second surfaces, and wherein the at least one third reinforcement ridge partially extends on the first surface and integrates with the at least one first reinforcement ridge and partially extends on the second surface.

8. The pipe wrench as claimed in claim 7, wherein the at least one reinforcement ridge includes at least one fourth reinforcement ridge extending from a corner between the second and third surfaces, and wherein the at least one fourth reinforcement ridge partially extends on the third surface and integrates with the at least second reinforcement ridge and partially extends on the second surface.

9. The pipe wrench as claimed in claim 8, wherein the at least one first and second reinforcement ridges are symmetrical.

10. The pipe wrench as claimed in claim 9, wherein the at least one first and second reinforcement ridges are mirror images of one another.

11. The pipe wrench as claimed in claim 8, wherein the first body includes a row of a plurality of teeth disposed between the handle portion and the first clamping portion, and wherein the second body defines a space and includes a worm restrained in the space and engaging with the plurality of teeth.

12. The pipe wrench as claimed in claim 2, wherein the at least one reinforcement ridge includes at least one second reinforcement ridge extending from a corner between the first and second surfaces, and wherein the at least one second reinforcement ridge partially extends on the first surface and integrates with the at least one first reinforcement ridge and partially extends on the second surface.

13. The pipe wrench as claimed in claim 12, wherein the outer periphery of the body portion includes a fourth surface opposite the second surface, and the second clamping portion extends from the fourth surface.

14. The pipe wrench as claimed in claim 7, wherein the first body includes a row of a plurality of teeth disposed between the handle portion and the first clamping portion, and wherein the second body defines a space and includes a worm restrained in the space and engaging with the plurality of teeth.

15. The pipe wrench as claimed in claim 1, wherein the first body includes a row of a plurality of teeth disposed between the handle portion and the first clamping portion, and wherein the second body defines a space and includes a worm restrained in the space and engaging with the plurality of teeth.

* * * * *